US007399041B2

(12) United States Patent
Prentner et al.

(10) Patent No.: US 7,399,041 B2
(45) Date of Patent: Jul. 15, 2008

(54) DRAWER OPENING GUIDE COMPRISING AN AUTOMATIC RETRACTING DEVICE WITH AN INTEGRATED DAMPING MECHANISM

(75) Inventors: Christian Prentner, Altach (AT); Guenter Grabher, Fussach (AT)

(73) Assignee: Alfit AG, Goetzis (AU)

( * ) Notice: Subject to any disclaimer, the term of this patent is extended or adjusted under 35 U.S.C. 154(b) by 130 days.

(21) Appl. No.: 10/566,520

(22) PCT Filed: Jul. 28, 2004

(86) PCT No.: PCT/EP2004/008411

§ 371 (c)(1),
(2), (4) Date: Jan. 30, 2006

(87) PCT Pub. No.: WO2005/011438

PCT Pub. Date: Feb. 10, 2005

(65) Prior Publication Data

US 2006/0238089 A1 Oct. 26, 2006

(30) Foreign Application Priority Data

Jul. 31, 2003 (DE) ..... 203 11 795 U

(51) Int. Cl.
*A47B 88/00* (2006.01)

(52) U.S. Cl. ..... 312/333; 312/334.44

(58) Field of Classification Search ..... 312/333, 312/334.44, 334.27, 334.1, 334.7, 319.1, 312/334.6, 334.46, 334.4; 384/21, 19
See application file for complete search history.

(56) References Cited

U.S. PATENT DOCUMENTS

| | | | | |
|---|---|---|---|---|
| 5,207,781 | A * | 5/1993 | Rock | 312/319.1 |
| 5,302,016 | A * | 4/1994 | Lautenschlager et al. | 312/333 |
| 5,474,375 | A * | 12/1995 | Hollenstein et al. | 312/319.1 |
| 6,629,738 | B2 * | 10/2003 | Salice | 312/333 |
| 6,736,471 | B2 * | 5/2004 | Lin | 312/333 |
| 6,846,053 | B2 * | 1/2005 | Salice | 312/334.14 |
| 6,953,233 | B2 * | 10/2005 | Lam et al. | 312/333 |
| 7,028,370 | B2 * | 4/2006 | Hoshide et al. | 16/96 R |
| 7,185,959 | B2 * | 3/2007 | Mueller et al. | 312/331 |
| 7,210,198 | B2 * | 5/2007 | Hoshide et al. | 16/96 R |

(Continued)

FOREIGN PATENT DOCUMENTS

| | | |
|---|---|---|
| DE | 40 20 277 | 1/1992 |

(Continued)

*Primary Examiner*—Janet M Wilkens
(74) *Attorney, Agent, or Firm*—Christa Hildebrand; Norris McLaughlin & Marcus, PA

(57) ABSTRACT

A drawer pull-out guide including an automatic retraction device having a pawl component with a receptacle that receives a catch on a running rail as the rails move relative to the guide rail when approaching a closed position and an entraining rocker. During a final part of retraction movement of the pawl component, the entraining rocker being coupled to and movable with the pawl component; and during an initial displacement path of the pawl component the entraining rocker being decoupled from the pawl component and retained against longitudinal displacement in the pawl housing. A first spring biasing the pawl component into a first end position and locking the pawl component; and a second spring for biasing the entraining rocker in a direction of retraction engages on the entraining rocker.

6 Claims, 3 Drawing Sheets

U.S. PATENT DOCUMENTS

| | | | | |
|---|---|---|---|---|
| 7,249,813 | B2 * | 7/2007 | Gasser | 312/333 |
| 2002/0033658 | A1 * | 3/2002 | Salice | 312/334.14 |
| 2004/0000850 | A1 * | 1/2004 | Lam Harn et al. | 312/333 |
| 2007/0046158 | A1 * | 3/2007 | Hoffman | 312/333 |
| 2007/0132346 | A1 * | 6/2007 | Huang | 312/333 |

FOREIGN PATENT DOCUMENTS

| | | |
|---|---|---|
| DE | 202 18 067 | 1/2003 |
| DE | 202 04 860 | 7/2003 |

* cited by examiner

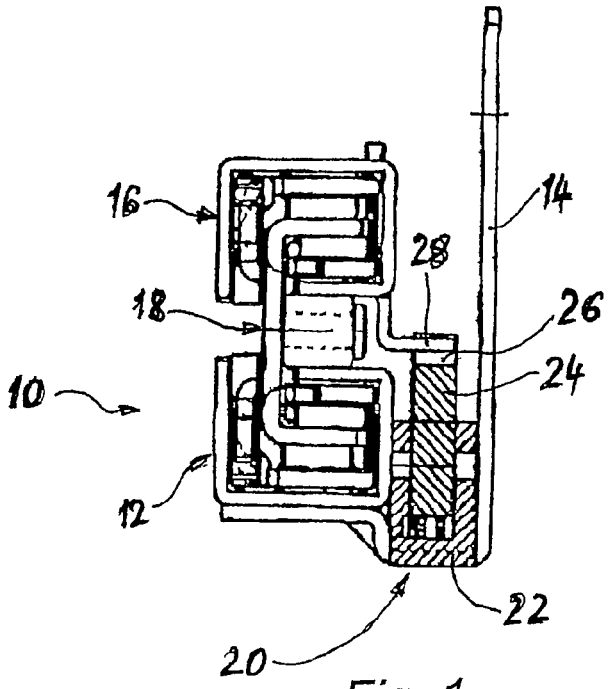
Fig. 1
Fig. 15
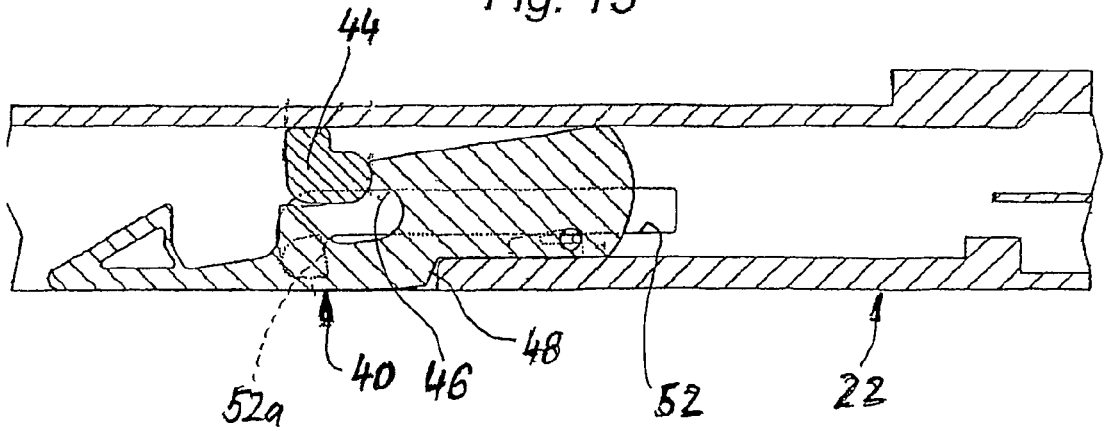

Fig. 12a
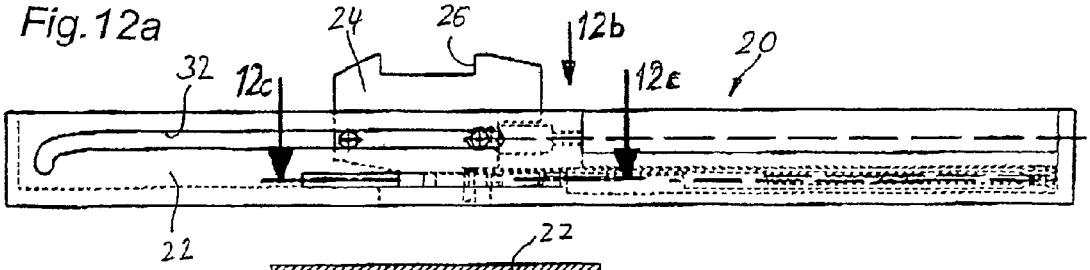
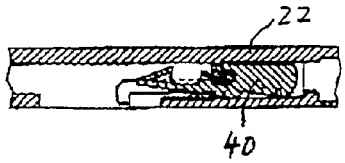
Fig. 12c
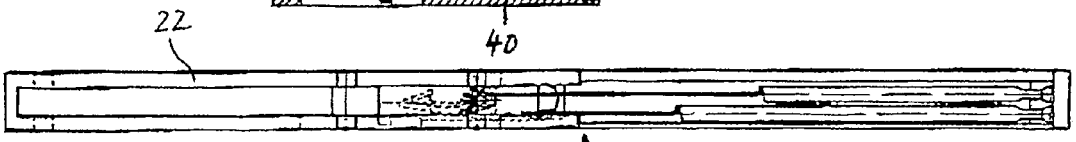
Fig. 12b
Fig. 13a
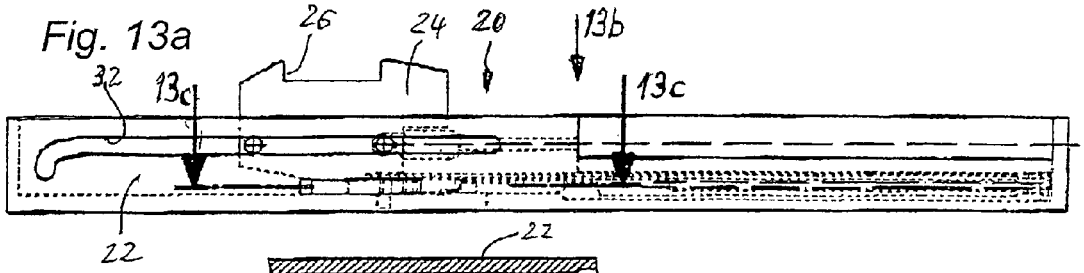
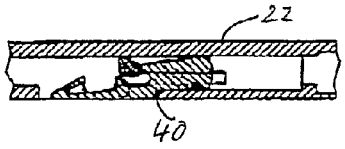
Fig. 13c
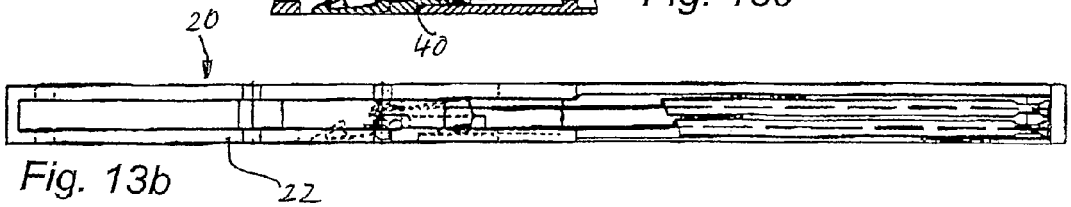
Fig. 13b
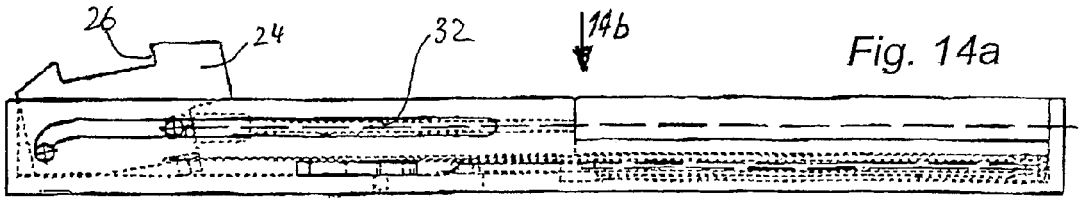
Fig. 14a
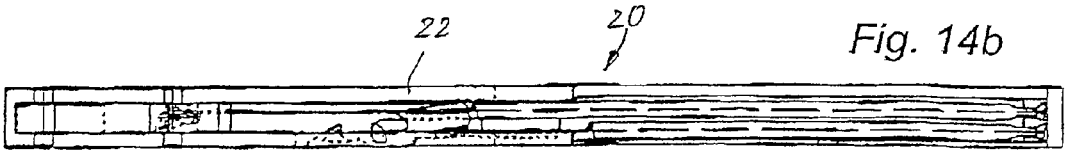
Fig. 14b

DRAWER OPENING GUIDE COMPRISING AN AUTOMATIC RETRACTING DEVICE WITH AN INTEGRATED DAMPING MECHANISM

The invention relates to a drawer pull-out guide provided with an automatic retraction device and with a guide rail to be fixed on a carcass wall of a piece of furniture and a running rail which is movably mounted relative to the guide rail and to be fixed on the drawer—optionally with a central rail interposed—wherein a pawl component which is movable between two end positions which are spaced from one another in the direction of movement of the drawer is provided in a pawl housing disposed on one of the two aforementioned outer rails, the pawl component being biased by a spring arrangement into one end position and lockable in the other end position against retraction into the first end position and having a receptacle for a catch which is provided on the other rail and which moves into the receptacle as the rails move relative to each other when approaching the closed position, thereby disengaging the pretensioned movable pawl component from the associated end position so that the pawl component is moved under the effect of spring tension into the first end position and by way of the catch held in the receptacle entrains the rail associated therewith in the direction of retraction of the drawer, a damper which acts on the pawl component being provided on or in the pawl housing to damp and/or slow down the retraction movement of the pawl component.

BACKGROUND OF THE INVENTION

Drawer guides which are provided with an automatic retraction device and by which during the closing movement before the completely closed position is reached a drawer held so that it can be pulled out on a cupboard carcass is forcibly retained by the tensional force of a biased spring in the closed position of the drawer and secured against inadvertent outward movement—for example by the reaction of the impact of the front drawer panel on the cupboard carcass or by displacement of air within the cupboard carcass when adjacent drawers are pushed in or pulled out—have been introduced to an increasing extent in recent years (e.g. DE 4 020 277 C2). Because modem drawer guides have a very easy action due to the mounting of the rails by means of anti-friction bearing or rollers, the bias of the biasing springs used for retraction must be such that the appertaining drawers can be securely retracted even in the event of relatively heavy loading and on the other hand drawers which are less heavily loaded are not accidentally opened even in the event of air currents in the carcass. In this case it has been shown that it is difficult to design the bias of a spring which is optimal and takes account of all requirements. As a rule, therefore, the tensional force of the spring is designed with a safety margin, but the consequence of this is that at least lighter drawers are speeded up on the retraction path and strike the cupboard carcass if it is not intentionally slowed down by the a person operating the drawer. Many furniture purchasers object to this jerky slamming or snapping shut, so that in recent years furniture manufacturers have changed over to the provision of dampers which are additionally effective between the drawers and the cupboard carcass during the automatic retraction process and which prevent the possibility of the drawer also being speeded up excessively by the spring of the automatic retraction device with its relative bias. In order for the design expenditure which is increased by the use of such additional damping and also the production expenditure—increased due to the necessary installation work—it has already been proposed that the damper which becomes effective during the automatic retraction movement should be integrated into the retraction device (DE 202 04 860.8). On the other hand, however, due to the use of dampers it is also necessary to increase the spring force of the automatic retraction device further in order to ensure that the associated drawer is closed exactly. This also produces the disadvantage during opening of the drawer that due to the usual longer spring path the spring force increases significantly, which results in unpleasantly high pull-out forces.

BRIEF SUMMARY OR THE INVENTION

The object of the invention, therefore, is to improve the automatic retraction devices with dampers developed for drawer pull-out guides in such a way that on the one hand the spring forces necessary for secure closing of the drawers are achieved without excessively high pull-out forces being produced when the drawer is pulled out.

Starting from a drawer pull-out guide of the type referred to in the introduction this object is achieved according to the invention in that an entraining rocker which is coupled to the pawl component and is movable during a final part of the retraction movement of the pawl component is additionally provided in the pawl housing and during the initial displacement path is decoupled therefrom and is retained so that it is secured against longitudinal displacement in the pawl housing, and that a separate spring which biases the entraining rocker in the direction of retraction engages on the entraining rocker. The arrangement of an entraining rocker which is coupled to the pawl component only over a part of the pull-out path and with which a separate spring is associated ensures that the pull-out force to be overcome during the first part of the pull-out movement is determined by the pull-out path of both springs, but that then because of the locking of the entraining rocker during the second part of the pull-out movement and decoupling of the pawl component only the force of the first spring to engage on the pawl component still has to be overcome.

In a preferred embodiment of the invention the movable pawl component is longitudinally movable in the elongate pawl housing which is U-shaped in cross-section and is guided in the end which is at the front in the direction of retraction of the drawer for locking so as to be pivotable about an axis which extends at right angles to the direction of displacement, the entraining rocker being provided in the surface of the pawl component between the inner face of the web of the pawl housing facing the pawl component and the surface within the housing facing it.

As a result the design can be such that in one of the side walls of the pawl housing forming the leg of the U-shaped cross-section in the pull-out direction to the entraining rocker a recess which extends in the direction of displacement of the pawl component can be provided in which a portion of the entraining rocker can be pivoted into a predetermined displacement position and can be locked against further displacement, wherein from the boundary surface of the pawl component facing the entraining rocker an entraining lug projects towards the entraining rocker and in the position of the entraining rocker in which it is not pivoted into the recess of the pawl housing engages in an associated receptacle in the entraining rocker and couples the latter to the pawl component in the position of the entraining rocker in which it is pivoted into the recess but freely comes out of the receptacle, as a result of which the pawl component is decoupled from the entraining rocker.

In this case it is recommended to provide an elongate depression or through opening extending in the direction of displacement of the pawl component in the inner surface of the web of the pawl housing in which a lug projecting from the facing flat face of the entraining rocker engages, wherein in the end region opposite the lug in the pivoted-out position of the entraining rocker the elongate recess then has a laterally enlarged receiving portion for the lug into which the lug is moved in the pivoted-out position of the entraining rocker, i.e. the position in which it is locked in the pawl housing.

In order to ensure the pivoting of the entraining rocker along the desired partial pull-out path, in a variant of the invention it is proposed that the end surfaces of the receptacle in the entraining rocker are constructed as oblique surfaces extending obliquely with respect to the direction of displacement of the pawl component in such a way that during displacement of the pawl component in the drawer pull-out direction the entraining lug projecting from the pawl component slides on the associated oblique surface and pivots the entraining rocker out into the associated recess but during displacement of the pawl component in the drawer retraction direction on entering the receptacle the entraining lug slides downwards on the associated oblique surface and pivots the entraining rocker back out of the recess.

BRIEF DESCRIPTION OF THE DRAWINGS

The invention is explained in greater detail in the following description with reference to the drawings of an embodiment, in which:

FIG. 1 shows a vertical sectional view through an embodiment of a drawer pull-out guide according to the invention with an automatic retraction device;

FIGS. 12*a* to 12*c* each show a side view, a plan view and a sectional view of the automatic retraction device shown in FIGS. 2 to 5 without the linear damper in the completely retraction position of the pawl component;

FIGS. 13*a* to 13*c* show views of the automatic retraction device which correspond to the representations in FIGS. 12*a* to 12*c* in an intermediate position of the pawl component in which the entraining rocker is locked in the pawl housing;

FIGS. 14*a*, 14*b* show views of the automatic retraction device corresponding to FIGS. 12*a* and 12*b* in the fully pulled-out position of the pawl component in which it is locked against being pulled back by the spring force acting on it; and FIG. 15 shows a sectional view on an enlarged scale corresponding to FIG. 13 showing the entraining rocker in the position in which it is locked in the pawl housing.

DETAILED DESCRIPTION OF THE INVENTION

Figures 2, 3, 4, 5, 6, 7, 8, 9, 10, 11:
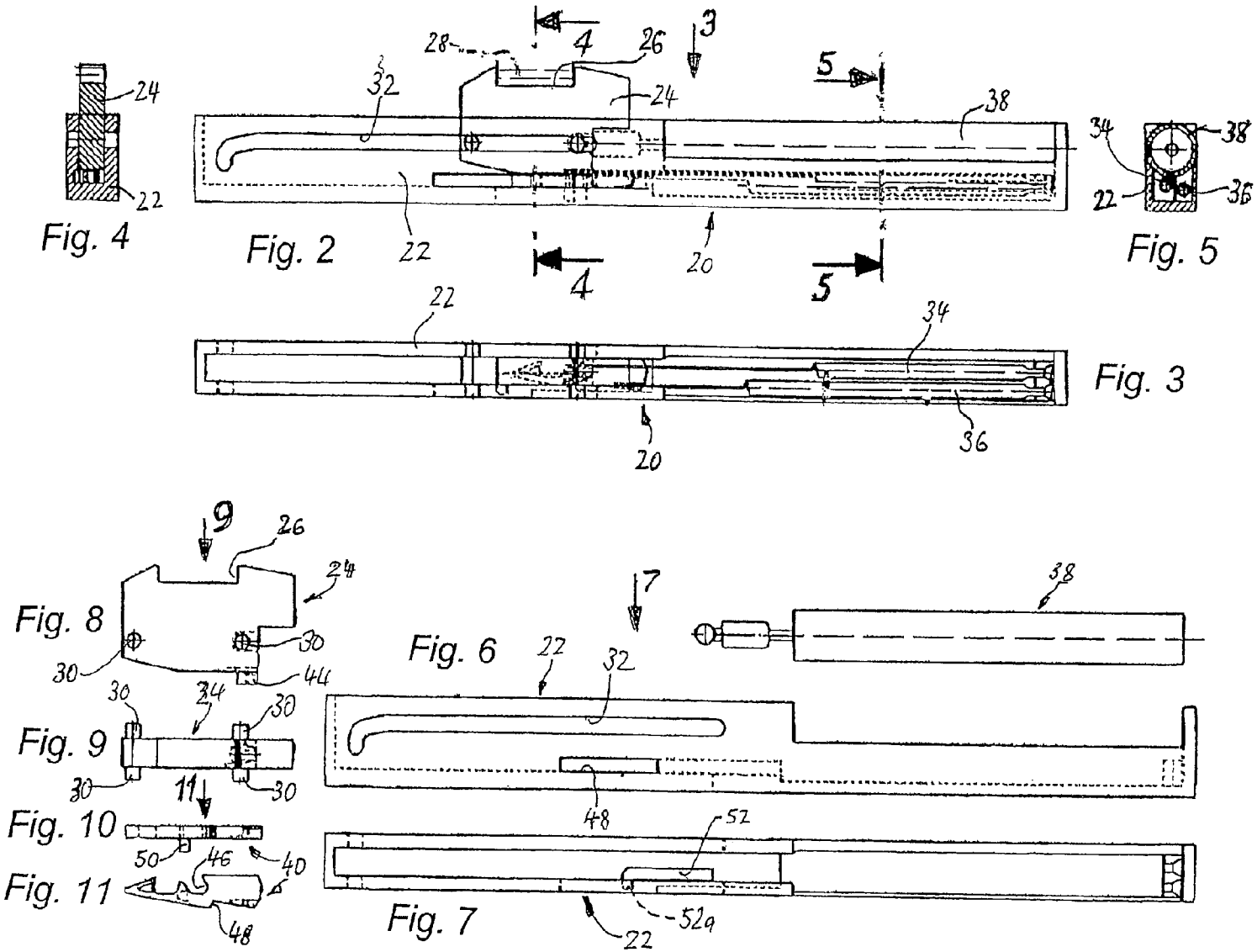
FIG. 2 shows a side view of the automatic retraction device of the pull-out guide shown in FIG. 1.
FIG. 3 shows a plan view in the direction of the arrow 3 in FIG. 2.
FIG. 4 shows a sectional view in the direction of the arrows 4-4 in FIG. 2.
FIG. 5 shows a sectional view in the direction of the arrows 5-5 in FIG. 2.
FIG. 6 shows a view of the pawl housing of the automatic retraction device of the pull-out guide according to the invention in the viewing direction corresponding to FIG. 2 with a liner damper shown lifted off from the pawl housing.
FIG. 7 shows a view of the pawl housing in the direction of the arrow 7 in FIG. 6.
FIG. 8 shows a side view of a pawl component guided so as to be longitudinally displaceable in the pawl housing according to FIGS. 6 and 7.
FIG. 9 shows a view of the pawl component in the direction of the arrow 9 in FIG. 8.
FIG. 10 shows a side view of an entraining rocker which is likewise guided so as to be longitudinally displaceable in the pawl housing.
FIG. 11 shows a view of the entraining rocker in the direction of the arrow 11 in FIG. 10.

FIG. 1 shows a sectional view taken at right angles to the pull-out direction through a pull-out guide denoted as a whole by 10, the guide rail 12 of which can be fixed on the supporting wall (not shown) of a cupboard carcass by way of a vertical fixing leg 14. On the other hand, the running rail 16 can be placed in the open underside of a side wall frame—likewise not shown—of a drawer as a closed metal hollow profile. In the special case the pull-out guide 10 is constructed as a full pull-out means, i.e. between the guide rail 12 end the running rail 16 a central rail 18 is also disposed which is formed by a metal profile of U-shaped cross-section, of which the legs which are bent horizontally at right angles from the connecting web part and are guided into the interior of the guide rail 12 or of the running rail 16 are guided and retained by anti-friction bearings constructed in the illustrated case as rollers mounted in cages so as to be longitudinally displaceable in each case relative to the associated rail. Since this design of drawer pull-out guides is known per se and the invention is not limited to the type of pull-out guides described in the special embodiment, the pull-out guide 10 is not described in detail below.

The automatic retraction device 20 which is illustrated in section in the drawings and is explained in greater detail below in connection with FIGS. 2 to 11 is disposed in the intermediate space formed between the guide rail 12 and the fixing leg 14 intended for fixing the guide rail on a supporting wall. The automatic refraction device 20 has a pawl housing 22 which is of approximately U-shaped construction in cross-section and in which a pawl component 24 is guided so as to be longitudinally displaceable over a predetermined path, wherein in the upper edge region of the pawl component projecting out of the pawl housing 22 a receptacle 26 is provided in which the horizontal leg of an angled catch fixed on the running rail can engage. When the running rail 16 is displaced relative to the guide rail 12 in the pull-out direction, the catch 28 engaging in the receptacle 26 entrains the pawl component 24, so that the pawl component 26 is entrained over the displacement path provided in the pawl housing.

The automatic retraction device 20 corresponds in principle to the aforementioned automatic retraction device already known from DE 40 20 277 C2, i.e. the flat pawl component 24 which is shown separately in FIGS. 8 and 9 and is provided with the receptacle 26 has on each of its opposing flat sides a pair of guide lugs 30 which are spaced from one another and engage in elongate slot-like guides 32 provided in the facing inner faces of the pawl housing 22. Over the greater part of their longitudinal extent the guides 32 extend in a straight line and are only curved in an arc in their left-hand end region shown in FIGS. 2 and 6 so that the appertaining guide lugs 30 are guided downwards into the left-hand end position in the curved end portions when the pawl component 24 is displaced and then pivot the pawl component 24 into the tilted end position shown in FIG. 14 in which the catch 28 provided on the running rail 16 can enter or leave the receptacle 26 depending upon the direction of displacement of the running rail relative to the guide rail 12. In the tilted end position the pawl component 24 is locked by an elongate helical spring 34. The locking takes place by displacement of the running rail 16 or of the drawer resting on the running rail in the direction into the interior of the carcass. The catch provided on the running rail 16 then exerts a force on the right-hand limit of the receptacle 26 in FIG. 8, as a result of which the pawl component is tilted back out of the locked position and disengaged. Due to the bias of the spring 34 the pawl component is then drawn into the right-hand end position shown in FIGS. 12*a* and 12*c* and thereby entrains the running rail 16 and the drawer resting thereon into the completely retracted position.

The retraction movement is slowed down by a damper constructed as an elongate piston damper 38 (FIGS. 2 and 6) as a function of the speed, so that the drawer is guided into the end position without impact and without corresponding resulting vibrations.

In the case of drawers with a high carrying capacity and also potentially high dead weight, the spring 34 must engage with a corresponding high biasing force on the locked pawl component 24. The consequence of this is that during opening of a drawer a correspondingly high pull-out force must be generated until the pawl component 24 is locked in the pawl housing 22. This means that as pulling out begins the drawer has a significant resistance to pulling out, which is already undesirable for reasons of comfort.

In order to create a marked reduction in this resistance to pulling out and nevertheless to ensure smooth and complete retraction of a drawer mounted with the pull-out guide 10 according to the invention in a cupboard carcass, in a variant according to the invention it is proposed that the retraction forced exerted by the spring 34 on the pawl component is only so strong that the opening force to be exerted by a person opening the drawer is of a comfortable magnitude, i.e. not too high, even in the end region of the locking path. On the other hand, in order as the drawer approaches the closed position in which the biasing force of the spring 34 decreases markedly due to the largest possible displacement path the closing force is kept sufficiently high in order to close the drawer completely and reliably, in a variant according to the invention a second spring 36 (FIG. 3) is disposed parallel to the spring 34 in the pawl housing 22 and the end of this second spring near the pawl component does not engage directly on the pawl component 24 but on an entraining rocker 40 which is displaceable together with the pawl component in the pawl housing 22 and is shown separately in FIGS. 10 and 11.

A crucial factor in ensuring that the total force necessary for pulling out the drawer does not rise again to an undesirable value due to the spring 36 additionally engaging on the entraining rocker 40, the entraining coupling of the entraining rocker 40 with the pawl component 24 only occurs over a first part of the pull-out path during which the two springs 34, 36 build up relatively low spring forces in spite of their parallel arrangement. After a first part of the pull-out path the entraining rocker 40 is decoupled from the pawl component 24 and locked in the pawl housing 22, so that then over the rest of the pull-out path only the spring tension of the spring 34 exerts a restoring force on the pawl component 24. Thus when the drawer is closed the automatic retraction device 20 first of all exerts the closing force built up in the spring 34 as the closed position is approached and retracts the drawer by way of the catch 28 and the running rail 16. After a predetermined part of the retraction path the entraining coupling of the pawl component 24 to the entraining rocker 40 is restored, so that the latter is disengaged from the pawl housing 22. As a result in addition to the force of the already partially relaxed spring 34 the biasing force of the additional spring 36 then becomes effective and the total retraction force is increased to a value necessary for reliable closing of the drawer.

For the embodiment of the pull-out guide according to the invention which is described here, the actual release of the entraining coupling of the entraining rocker 40 to the pawl component 24 only during a part of the total retraction or pull-out path is produced by an arrangement whereby the entraining rocker 40 is disposed between the inner face of the web of the pawl housing 22 facing the pawl component and the underside of the pawl component 24 facing it, wherein an entraining lug 44 projects from the underside of the pawl component 24 towards the entraining rocker 40 and is for its part disposed below the pawl component 24 so as to be pivotable or tiltable in the transverse direction in the pawl housing 22. Associated with the entraining lug 44 is a receptacle 46 in the entraining rocker 40 in which the entraining lug 44 engages during the entraining coupling of the pawl component 24 and entraining rocker 40.

In alignment with the entraining rocker 40 there is provided in the pawl housing 22 a recess 48 which extends in the direction of displacement of the pawl component and into which a portion of the entraining rocker 40 can be pivoted in a predetermined displacement position and can be locked against further displacement. This locked position is shown for example in FIG. 13*c* and—on an enlarged scale—in FIG. 15. In this position of the entraining rocker 40 in which it is pivoted into the recess 48 the entraining lug 44 can come out of the receptacle 46 and is then decoupled from the entraining rocker during the further tension of the pawl component 24. Due to the oblique design of the limits of the receptacle 46 the entraining lug 44 forcibly tilts the entraining rocker 40 into the locked position or unlocks it again when each respective end of the partial displacement path of the entraining rocker 40 is reached. The locking itself takes place on a step 48 of the entraining rocker 40 or by means of a lug 50 which projects from the entraining rocker 40 to the base of the pawl housing 22 and engages in an elongate depression or through opening 52 which extends in the base of the pawl housing 22 and has on one end a laterally enlarged receiving portion 52*a* for the lug 50 so that when the entraining rocker 40 is tilted the lug 50 goes over into this receiving portion.

Three different positions of the pawl component 24 are illustrated in FIGS. 12*a* to 14*b* in different views or sections. In FIGS. 12*a* to 12*c* the position of the pawl component 24 and also of the entraining rocker 40 in locking engagement with the pawl component is shown in the completely retracted end position. In FIGS. 13*a* to 13*c* in a corresponding representation the position of the pawl component 24 is shown in the displacement position in which the entraining coupling of the entraining rocker 40 already locked in the pawl housing 22 is released, whilst in FIGS. 14*a* and 14*b* the outermost end position of the pawl component 24 is shown in which the pawl component 24 is locked in its tilted end position, so that the catch 28 provided on the running rail 16 can leave the receptacle 26 or enter the receptacle 26.

The invention claimed is:

1. A drawer pull-out guide comprising:

a guide rail;

a running rail movably mounted relative to the guide rail, the running rail having a catch;

an automatic retraction device comprising:

a pawl housing disposed on the guide rail;

a pre-tensioned pawl component movable within the pawl housing between a first end position and a second end position, the two end positions being spaced apart from one another in a direction of movement, the pawl component having a receptacle defined therein configured to receive the catch of the running rail as the rails move relative to each other when approaching a closed position, thereby disengaging the movable pawl component from the second end position so that the pawl component is moved under the effect of spring tension into the first end position and by way of the catch held in the receptacle entrains the running rail associated therewith in the direction of retraction;

an entraining rocker provided in the pawl housing; during a final part of retraction movement of the pawl component, the entraining rocker being coupled to and movable with the pawl component; and during an initial displacement path of the pawl component, the entraining rocker being decoupled from the pawl component and retained against longitudinal displacement in the pawl housing;

a first spring disposed for biasing the pawl component into the first end position and locking the pawl component in the first end position against refraction into the second end position:

a damper acting on the pawl component to slow down refraction movement of the pawl component; and a second spring for biasing the entraining rocker in a direction of retraction engages on the entraining rocker.

2. The drawer pull-out guide in accordance with claim 1, wherein the pawl housing has a U-shaped cross-section and guides defined longitudinally therein along which the pawl component is displaceable, the guides at one end disposed at the front in a direction of retraction extend at substantially right angles relative to the direction of displacement causing the pawl component to pivot about an axis while the catch is received in the receptacle locking the pawl component in place; and the entraining rocker is disposed between an inner surface of the pawl housing facing the pawl component and a surface of the pawl component facing it.

3. The drawer pull-out guide in accordance with claim 2, wherein the U-shaped cross-section pawl housing is formed by side walls in one of which a recess is defined therein that extends in a direction of displacement of the pawl component in which a portion of the entraining rocker is pivotable into a predetermined displacement position and lockable against further displacement;

and further comprising an entraining lug projecting from a surface of the pawl component facing the entraining rocker towards the entraining rocker; wherein in a position in which the entraining rocker is not pivoted into the access of the pawl housing, the entraining lug engages an associated receptacle in the entraining rocker and couples the latter to the pawl component; while in a position in which the entraining rocker is pivoted into the recess, the entraining lug freely comes out of the associated receptacle in the entraining rocker, as a result of which the pawl component is decoupled from the entraining rocker.

4. The drawer pull-out guide in accordance with claim 3, wherein the inner surface of the pawl housing has an elongated opening defined therein extending in a direction of displacement of the pawl component in which an engaging lug projecting from the facing flat face of the entraining rocker engages, in an end region opposite the engaging lug in the pivoted-out position of the entraining rocket the elongate opening forming a laterally enlarged receiving portion for the engaging lug and into which the engaging lug is moved when the entraining rocker is in the pivoted-out position.

5. The drawer pull-out guide in accordance with claim 3, wherein the receptacle in the entraining rocker has end surfaces extending obliquely relative to a direction of displacement of the pawl component so that during displacement of the pawl component in the drawer pull-out direction the entraining lug projecting from the pawl component slides on the associated oblique surface and pivots the entraining rocker into the associated recess; but during displacement of the pawl component in a refraction direction on entering the receptacle the entraining lug slides downwards on the associated oblique surface and pivots the entraining rocker out of the recess.

6. The drawer pull-out guide in accordance with claim 1, further comprising a central rail interposed between the running rail and the guide rail.

* * * * *

UNITED STATES PATENT AND TRADEMARK OFFICE

CERTIFICATE OF CORRECTION

PATENT NO. : 7,399,041 B2
APPLICATION NO. : 10/566520
DATED : July 15, 2008
INVENTOR(S) : Prentner et al.

It is certified that error appears in the above-identified patent and that said Letters Patent is hereby corrected as shown below:

Title page Item (57), Abstract; line 8, "pawl component the entraining rocker" should read -- pawl component, the entraining rocker --

Column 2, line 13, "BRIEF SUMMARY OR THE INVENTION" should read -- BRIEF SUMMARY OF THE INVENTION --

Column 4, line 18, "between the guide rail 12 end the" should read -- between the guide rail 12 and the --

Column 8, line 33, "the pawl component in a refraction direction on entering the" should read -- the pawl component in a retraction direction on entering the --

Signed and Sealed this

Seventeenth Day of March, 2009

JOHN DOLL
*Acting Director of the United States Patent and Trademark Office*